US005469197A

United States Patent [19]

Hiramatsu

[11] Patent Number: 5,469,197

[45] Date of Patent: Nov. 21, 1995

[54] RECORDING APPARATUS FOR CONTROLLING CONVEYANCE SPEED OF RECORDING MEDIUM IN ACCORDANCE WITH A TYPE OF RECORDING DATA TO BE RECORDED

[75] Inventor: Soichi Hiramatsu, Yokohama, Japan

[73] Assignee: Canon Kabushiki Kaisha, Tokyo, Japan

[21] Appl. No.: 115,126

[22] Filed: Sep. 1, 1993

Related U.S. Application Data

[63] Continuation of Ser. No. 763,254, Sep. 20, 1991, abandoned.

[30] Foreign Application Priority Data

Sep. 21, 1990 [JP] Japan ..... 2-252271

[51] Int. Cl.[6] ..... B41J 2/01; B41J 19/96

[52] U.S. Cl. ..... 347/16; 347/104

[58] Field of Search ..... 347/16, 104, 5; 346/136

[56] References Cited

U.S. PATENT DOCUMENTS

| | | | |
|---|---|---|---|
| 4,097,873 | 6/1978 | Martin | 346/136 X |
| 4,224,628 | 9/1980 | Murray | 346/136 X |
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,613,872 | 9/1986 | Naito | 346/136 X |
| 4,702,630 | 10/1987 | Igi | 400/82 |
| 4,723,129 | 2/1988 | Endo et al. | 347/56 |
| 4,728,968 | 3/1988 | Hillmann | 347/16 X |
| 4,734,868 | 3/1988 | Delacy | 346/136 X |
| 4,740,796 | 4/1988 | Endo et al. . | |

FOREIGN PATENT DOCUMENTS

| | | | |
|---|---|---|---|
| 54-56847 | 5/1979 | Japan . | |
| 58-056085 | 4/1983 | Japan . | |
| 59-123670 | 7/1984 | Japan . | |
| 59-138461 | 8/1984 | Japan . | |
| 60-71260 | 4/1985 | Japan . | |
| 60-116488 | 6/1985 | Japan . | |
| 61-195853 | 8/1986 | Japan | B41J 3/04 |
| 62-119074 | 5/1987 | Japan . | |

*Primary Examiner*—Joseph W. Hartary

*Attorney, Agent, or Firm*—Fitzpatrick, Cella, Harper & Scinto

[57] ABSTRACT

A recording apparatus has a recording device to record an image onto a sheet in accordance with input recording data, a relative moving device to relatively move the sheet for the recording device, a driver to drive the relative moving device, and a controller to control a driving speed of the driver in different modes in accordance with the kind of recording data. In the case of graphics data or data including a block graphic character, the driver is controlled in a constant driving speed mode. In the case of ordinary character data, the driving speed of the driver is increased for a predetermined time and, thereafter, the driving speed is reduced for a predetermined time.

13 Claims, 5 Drawing Sheets

RECORDING APPARATUS FOR CONTROLLING CONVEYANCE SPEED OF RECORDING MEDIUM IN ACCORDANCE WITH A TYPE OF RECORDING DATA TO BE RECORDED

This application is a continuation of application Ser. No. 07/763,254 filed Sep. 20, 1991, now abandoned.

BACKGROUND OF THE INVENTION

1. Field of the Invention

The invention relates to a recording apparatus for recording an image on a sheet in accordance with recording data.

2. Related Background Art

In a conventional recording apparatus, generally, a pinch roller comes into pressure contact with a carrying roller and the carrying roller is driven and rotated, thereby conveying a recording sheet and executing a predetermined recording onto the conveyed recording sheet. A driving force of a stepping motor or the like is transferred by using a gear train and the like in order to drive the carrying roller.

In the above recording apparatus, a recording head having recording elements which are constructed on a dot unit basis is driven due to the movement of a carriage, one line is recorded, and the recording sheet is conveyed by a distance of the recording of one line every completion of the one-line recording.

In recent years, the realization of a high recording density has progressed more and more and there are many apparatuses in which the recording elements are arranged on a micro unit basis of a few dots/mm.

In such a recording apparatus, for instance, when considering a case where ordinary characters are printed one line by one, a certain space generally exists between the lines and even if there is a difference of a carrying amount of the order of a unit which lies within a range from a few microns to hundreds of microns as a carrying precision among the lines, such a difference cannot be judged by the eyes.

However, for instance, in the case of graphics such that a picture or the like is formed on a micro dot unit basis, with a block graphic character (BGC) such as ruled lines of a table or the like, which have previously been formed on a character unit basis, or the like, the first line and the next line are adjacently formed. Thus, there is a problem such that in the case where a carrying precision is low and a difference of the carrying amount occurs between the lines, for instance, a white line appears between the lines or the lines are overlaid and a black line appears.

Although a carrying precision of a certain extent is needed in the character printing or the like, significances of the carrying speed, sound, and the like are higher. There is a problem such that if graphics or the like are recorded by a driving method which has been set in accordance with the character printing, the carrying precision is low, so that a white line, a black line, or the like appears between the lines.

On the contrary, according to a carrying method in which a largest significance is given to the carrying precision, there is an unpractical problem such that a sheet feeding speed upon character printing which is generally used becomes slow or the like.

SUMMARY OF THE INVENTION

The invention is made in consideration of the above drawbacks and it is an object of the invention to provide an improved recording apparatus.

Another object of the invention is to provide a recording apparatus which can execute the driving according to the kind of recording data in the relative movement of recording means and a sheet.

Still another object of the invention is to provide a recording apparatus which can prevent the generation of a white line, a black line, and the like upon printing of graphics or block graphic characters without deteriorating a total printing speed or noise level in the normal mode.

Further another object of the invention is to provide a recording apparatus in which in the character printing mode which is ordinarily frequently used, a sheet feeding of a high sheet feeding speed and low noise can be realized and, in the printing mode in the case where block graphic characters are included in graphics recording data, a sheet feeding of a high feeding precision can be realized.

The above and other objects and features of the present invention will become apparent from the following detailed description and the appended claims with reference to the accompanying drawings.

DETAILED DESCRIPTION OF THE PREFERRED EMBODIMENTS

Figure 1:
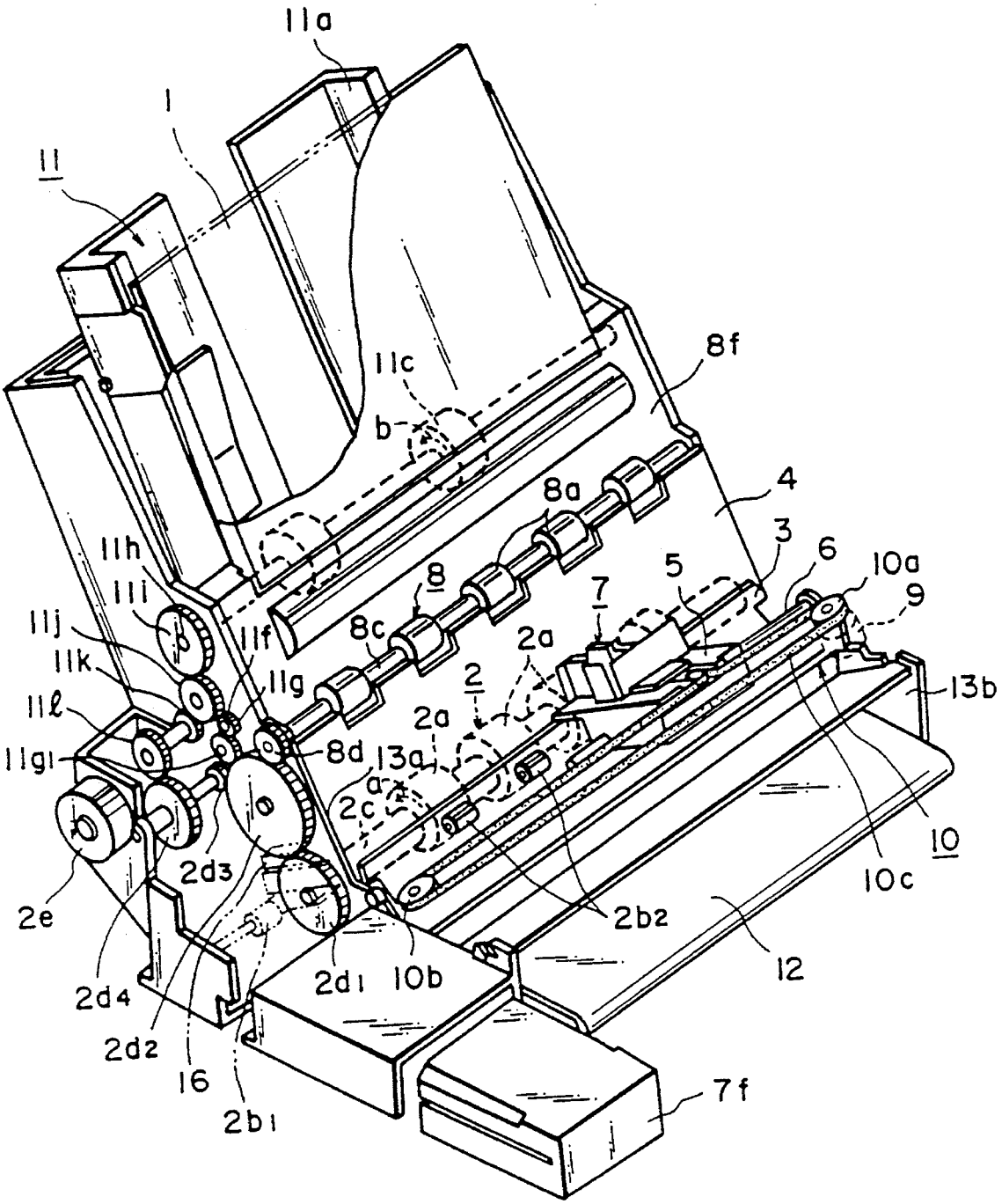
FIG. 1 is a perspective view showing a structure of a recording apparatus according to the invention.

An embodiment of the invention will be described in detail hereinbelow with reference to the drawings.

<Whole structure>

A whole structure of an apparatus will be first described with reference to FIG. 1. A recording sheet 1 as a recording medium is carried by sheet carrying means 2. The recording sheet 1 is pressed to carrying rollers 2*a* by a sheet pressing member 3 so as to prevent floating up from a platen 4.

When the sheet 1 is carried, a carriage 5 is reciprocated along a guide rail 6. An image is recorded onto the sheet 1 by driving recording means 7. The sheet 1 after completion of the recording is discharged by discharging means 8.

A driving force of a carriage motor 9 as a driving source is transferred to the carriage 5 through a timing belt 10*c* which comprises transfer means 10, so that the carriage 5 is reciprocated.

A construction of each section in the recording apparatus will now be practically explained.

<Sheet carrying means>

The sheet carrying means 2 carries the recording sheet 1 to the recording means 7. In the embodiment, a recording sheet which has been fed from an ASF (Auto Sheet Feeder) 11 which is detachably attached to the recording apparatus or a recording sheet which has manually been inserted from a hand inserting port 12 is carried by the sheet carrying means 2.

The sheet carrying means 2 in the embodiment rotates the carrying rollers 2*a* in the direction indicated by an arrow a and carries the recording sheet 1 by front pinch rollers $2b_1$ and rear pinch rollers $2b_2$ which are rotated in association with the rotation of the carrying rollers 2a.

A plurality of carrying rollers 2a are attached to a roller shaft 2c whose both edges are rotatably supported to left and right side walls 13a and 13b of the frame of the apparatus.

A driving force from a carrier motor 2e is transferred to the roller shaft 2c by a driving transfer structure of the gear train mentioned above. Practically speaking, a carrying gear $2d_1$ is attached to the roller shaft 2c. The gear $2d_1$ is in engagement with an idler gear $2d_2$. Further, the idler gear $2d_2$ is in engagement with a first transfer gear $2d_3$.

A second transfer gear $2d_4$ is attached to a shaft of the first transfer gear $2d_3$. The driving force from the carrier motor 2e is selectively transferred to the first and second transfer gears $2d_3$ and $2d_4$ by a clutch mechanism (not shown).

Therefore, when the driving force of the carrier motor 2e is transferred to the first transfer gear $2d_3$, the rotating force is propagated to the carrying gear $2d_1$ through the idler gear $2d_2$, so that the carrying rollers 2a are rotated.

The front and rear pinch rollers $2b_1$ and $2b_2$ are come into pressure contact with the surfaces of the carrying rollers 2a by a spring or the like (not shown), respectively, and are attached so as to be rotated in association with the rotation of the carrying rollers 2a. Therefore, the carrying force is applied to the recording sheet 1 because the sheet 1 is nipped by the carrying rollers 2a and the pinch rollers $2b_1$ and $2b_2$ which are rotating.

A paper pan which is curved along peripheral surfaces of the carrying rollers 2a is attached below the carrying rollers 2a. The paper pan is extended to the hand inserting port 12 and functions as a lower guide of the recording sheet 1 which has manually been inserted.

Further, upper guide plates are attached above the paper pan with a predetermined distance, thereby constructing a carrying path of the recording sheet 1.

In the above structure, when the carrier motor 2e is driven and the carrying rollers 2a are rotated in the direction of the arrow a in FIG. 1, the recording sheet 1 which has been fed from the ASF 11 is nipped by the front pinch rollers $2b_1$ and the carrying rollers 2a and is turned back and carried in a U-shaped along the peripheral surfaces of the carrying rollers 2a. Further, the sheet 1 is subsequently nipped by the rear pinch rollers $2b_2$ and the carrying rollers 2a and is carried to a recording position locating at an upper position.

On the other hand, the recording sheet 1 which has been fed from the hand inserting port 12 is nipped by the carrying rollers 2a and the rear pinch rollers $2b_2$ and is carried to the recording position.

The ASF 11 for automatically feeding the recording sheet 1 to the carrying means 2 will now be simply explained.

The ASF 11 is detachably attached to the recording apparatus. Among the recording sheets 1 enclosed in a cassette 11a, the top sheet 1 is pressed to separating rollers 11c by a pressing spring. When the separating rollers 11c rotate in the direction of an arrow b, one of the sheets in the top layer is separated and fed and comes into contact with nipping portions between resist rollers arranged in the downstream direction of the cassette 11a and the upper rollers which are in pressure contact with the resist rollers. When the resist rollers rotate, the recording sheet 1 is nipped by the resist rollers and the upper rollers which are rotated in association with the rotation of the resist rollers and is fed to the sheet carrying means 2.

According to the mechanism to transfer the driving force to the resist rollers, a resist gear 11g is attached to a roller shaft 11f to which the resist rollers are attached and the resist gear 11g is in engagement with the idler gear $2d_2$ through an idler gear $11g_1$.

On the other hand, according to the mechanism to transfer the driving force to the separating rollers 11c, a separating gear 11i is attached to a roller shaft 11h to which the separating rollers 11c are attached and idler gears 11j and 11k are sequentially in engagement with the gear 11i. Further, a gear 11l attached to the same shaft as that of the idler gear 11k is in engagement with the second transfer gear $2d_4$.

Therefore, when the carrier motor 2e is driven and the driving force is transferred through the above gear train, the separating rollers 11c or the resist rollers rotate.

<Sheet pressing member>

The sheet pressing member 3 presses the recording sheet 1 carried by the carrying means 2 to the carrying rollers 2, thereby preventing the recording sheet 1 from floating up from the platen 4.

The sheet pressing member 3 is made of a single plate-like member whose width is wider than a moving range of the carriage 5 so as to press the whole width region of the recording sheet 1 and is in pressure contact with the carrying rollers 2a by pressing means such as a spring or the like (not shown).

A front edge of the sheet pressing member 3 is located below the recording position by the recording means 7. The carried recording sheet 1 is pressed to the carrying rollers 2a by the member 3. Thus, the recording sheet 1 at the recording position doesn't float up from the platen 4.

<Carriage>

The carriage 5 is used to reciprocate the recording means 7 in the width direction of the recording sheet. 1.

The carriage 5 is slidably attached to the guide rail 6 whose both ends are fixed to the left and right side walls 13a and 13b and which functions as a guide member having a circular cross section.

The carriage 5 is attached so as to be rotatable around the guide rail 6 as a rotational shaft and is attached so that the front side of the carriage 5, that is, the side which faces the recording sheet 1, is inclined forward and downward. Thus, the front edge portion of the carriage comes into pressure contact with the sheet pressing member 3 by the dead weights of the carriage 5 and the recording means 7 mounted on the carriage 5.

Thus, a distance between the recording means 7 mounted on the carriage 5 and the recording sheet 1 is always maintained at a constant value.

The driving force of the carriage motor 9 is transferred to the carriage 5 by the transfer means 10 and the carriage 5 is reciprocated.

A driving pulley 10a is attached to one end of the moving range of the carriage 5 and a driven pulley 10b is attached to the other end. The carriage motor 9 is coupled to the driving pulley 10a. Further, the endless timing belt 10c serving as a transfer member is moved between the pulleys 10a and 10b parallel with the guide rail 6. A part of the timing belt 10c is fixed to the carriage 5.

<Recording means>

The recording means is mounted to the carriage 5 and records an ink image onto the recording sheet 1 which has been carried by the carrying means 2. An ink jet recording system is preferably used as the recording means in the apparatus.

The ink jet recording system comprises: liquid emitting ports each for emitting and spouting an ink liquid for recording as a flying liquid droplet; liquid channels communicated with the emitting ports; and emitting energy generating means each of which is provided in a part of the liquid channel and generates a emitting energy to form a flying liquid droplet of the ink liquid in the liquid channel. The emitting energy generating means is driven in accordance with an image signal and the ink liquid droplets are emitted, thereby recording an image.

As emitting energy generating means, for instance, it is possible to use either one of a method using a pressure energy generating means such as an electrical/mechanical transducing element such as a piezoelectric element or the like, a method using an electromagnetic energy generating means for generating a flying liquid droplet by irradiating an electromagnetic wave of a laser beam or the like and for allowing the electromagnetic wave to be absorbed into the ink liquid, a method using thermal energy generating means such as an electrothermal transducing element, and the like. Among the above methods, the method using the thermal energy generating means such as an electrothermal transducing element or the like is preferable because the emitting ports can be arranged at a high density and the recording head can be constructed in a compact size. In the embodiment, ink liquids are emitted by such a method. Capping means 16 is provided in a left edge portion in the moving range of the carriage 5. The capping means 16 has a function to cover the ink emitting surfaces of the recording head 7 in the non-recording mode or the like, thereby preventing the ink near the ink emitting ports of the recording head 7 from drying or the ink from solidifying due to such drying.

A pump (not shown) is connected to the capping means 16. The pump is driven to eliminate a defective emission of the ink, or to prevent such. The ink is sucked from the emitting port by a sucking force of the pump, thereby executing a recovering process.

<Discharging means>

The discharging means 8 is used to discharge the recording sheet which has been recorded by the recording means 7.

The discharging means 8 comprises discharging rollers 8*a* and spurs which are in contact therewith. A discharging gear 8*d* is attached to the edge portion of a roller shaft 8*c* of the discharging rollers 8*a*. The discharging gear 8*d* is in engagement with the idler gear $2d_2$.

Therefore, when the carrier motor 2*e* is driven, a driving force is transferred to the discharging rollers 8*a* and the rollers 8*a* are rotated, so that the recording sheet 1 is discharged by the cooperation of the discharging rollers 8*a* and the spurs. The discharged recording sheet 1 is stacked into a discharging stacker 8*f* located above the discharging rollers 8*a*.

A control according to the invention will now be described with reference to FIGS. 2 and 3.

Figure 2:
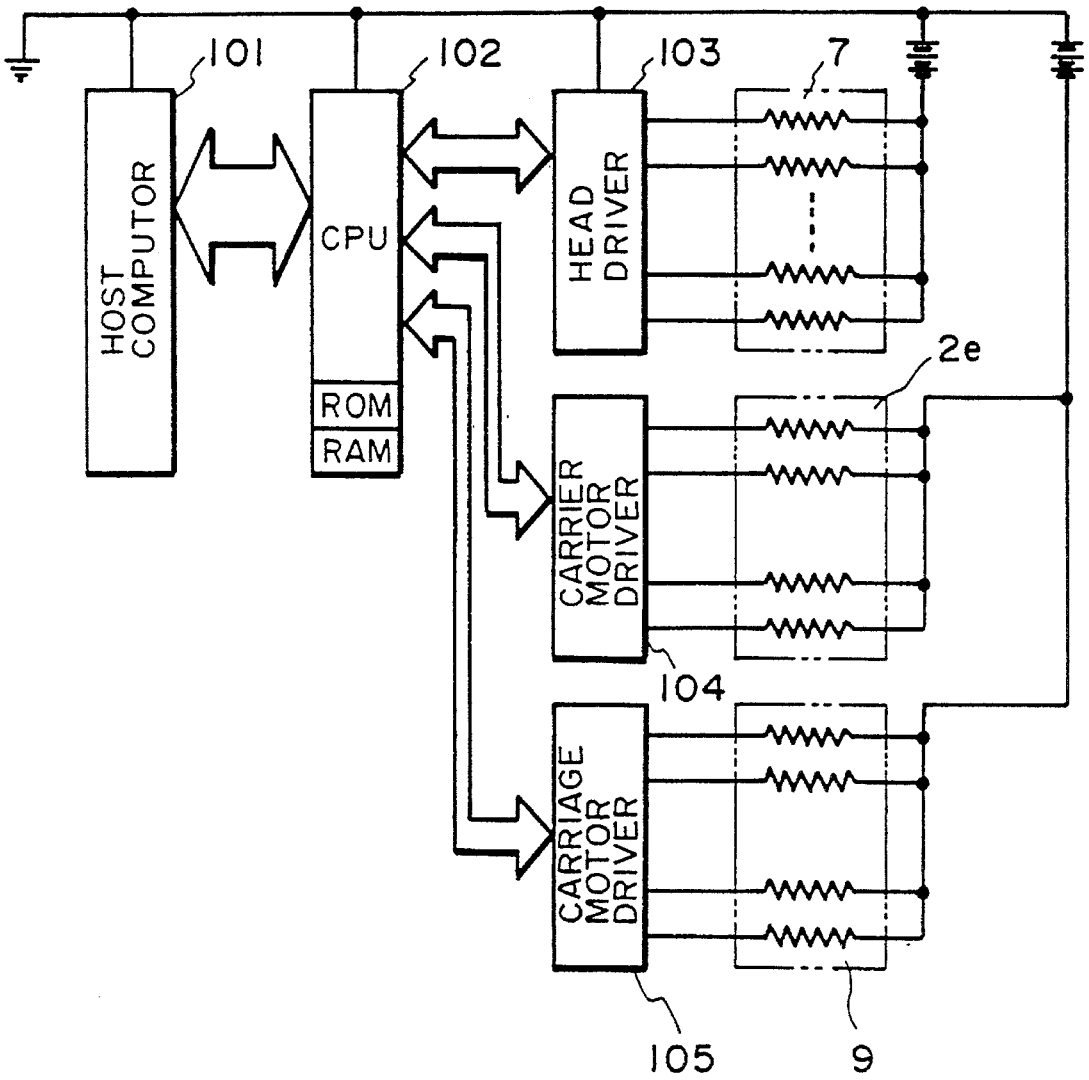
FIG. 2 is a block diagram showing a control section.

FIG. 2 is a block diagram showing a control section of the recording apparatus shown in FIG. 1. Reference numeral 101 denotes a host computer to transmit print data and various kinds of control signals and 102 indicates a CPU for executing a communication control with the host computer 101 and a sequence control of the recording apparatus. The CPU 102 mainly comprises a well-known one-chip microcomputer having therein an ROM, an RAM, and the like. Reference numeral 103 denotes a head driver to drive a heat generating element as emitting energy generating means of the recording means 7; 104 a carrier motor driver to drive the carrier motor 2*e*; and 105 a carriage motor driver to drive the carriage motor 9.

Figure 3:
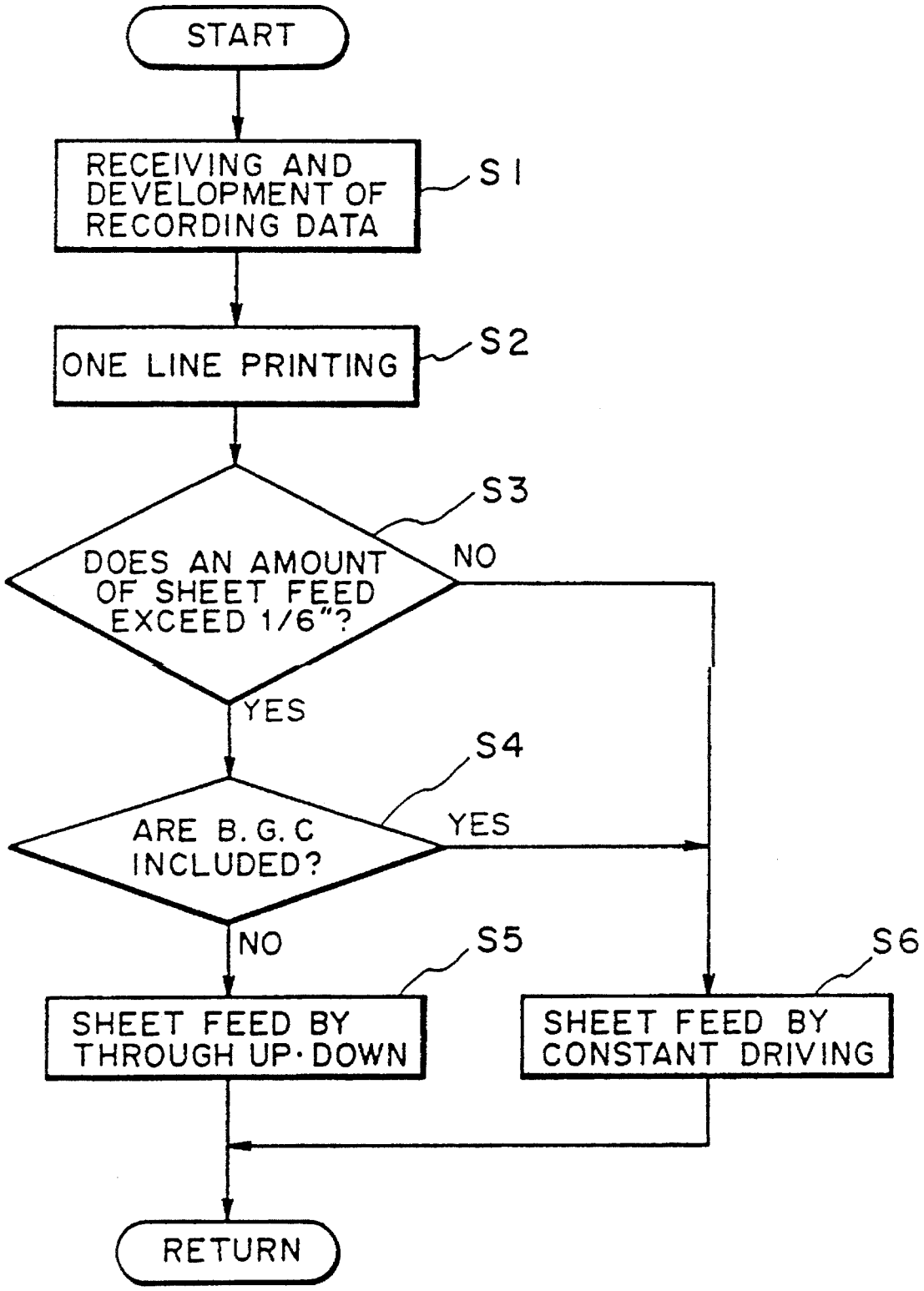
FIG. 3 is a flowchart showing a flow of a sheet feeding control according to the invention.

FIG. 3 is a flowchart showing a flow of the control which is executed by the CPU 102. A program according to the flowchart has been stored in the ROM in the CPU 102.

The CPU 102 receives data sent from the host computer 101 in step S1. The data includes characters, BGC, graphics data for an image printing, or the like. After the data is received, the data of one line is printed in step S2. A driving signal is sent from the CPU 102 to the carriage motor driver 105. While the carriage motor 9 is being moved, a signal for recording is sent to the head driver 103. The energy generating means (heat generating element) of the recording head 7 is driven, thereby printing the data of one line.

After the data of one line is printed, a sheet feed amount before the next line is printed to be is discriminated. In the invention, a stepping motor is used as a carrier motor and the carrier motor 2*e* is driven by 15 steps in order to feed the recording sheet by 1/6 inch. For instance, as shown in FIG. 4, seven steps are used for through up and seven steps are used for through down.

Figure 4:
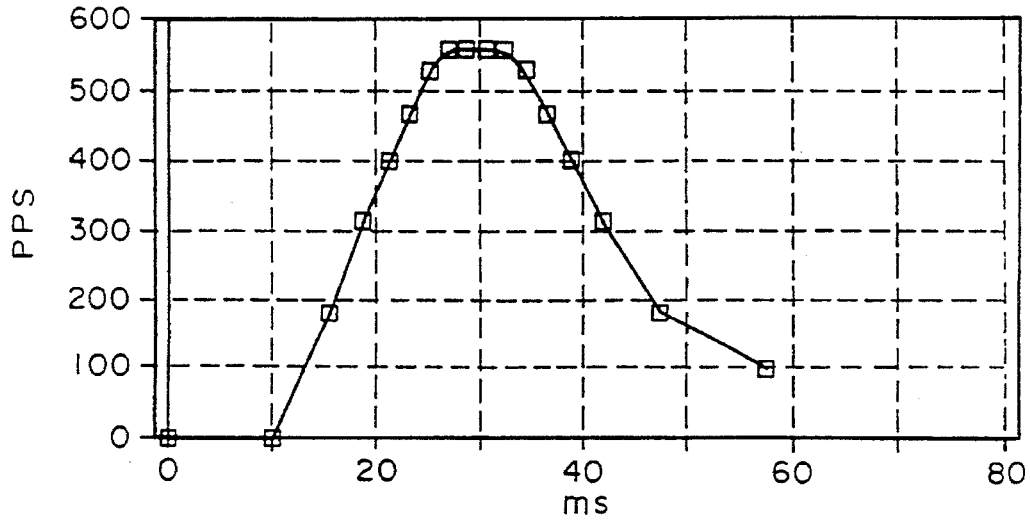
FIGS. 4 to 6 are diagrams for explaining a sheet feeding mode according to the invention.

In FIG. 4, an axis of abscissa denotes an elapsed time and an axis of ordinate indicates a driving speed (for instance, a unit is PPS (Pulses Per Second) or the like of the carrier motor 2*e*. A mark □ denotes a speed for the elapsed time of every step. The carrier motor 2*e* is driven while gradually increasing the speed in the former half seven steps. The carrier motor 2*e* is driven while gradually decreasing the speed in the latter half seven steps. Practically speaking, such a driving method denotes that a phase excitation switching time is first set to a long time and is set to the shortest time after seven steps and that the switching time is again set to a long time after that.

Returning to FIG. 3, the discriminating step S3 will now be described.

As mentioned above, since 14 steps are used for through up/down, for instance, in the case of feeding the sheet by a few steps, the above curve or table cannot be used. Therefore, in the case of feeding the sheet by a distance shorter than, e.g., 1/6 inch (15 steps), the carrier motor 2*e* is driven without using the table which can be used for a distance of 1/6 inch or more.

On the other bland, in the case where image data is transferred and graphics are printed, a sheet feed amount is ordinarily set to 12/90 inch. In the invention, the carrier motor 2*e* is driven by 12 steps. In the judgment in step S3, therefore, in the case of the graphics printing, the answer is NO and step S6 follows. In the case other than the graphics printing, it is determined that the sheet feed amount is equal to or larger than 1/6 inch. Thereafter, a check is made in step S4 to see if a BGC is included in the printing data or not. If NO, a sheet feeding by the through up/down, for instance, a sheet feeding using the curve shown in FIG. 4 is executed in step S5. If a BGC is included, a sheet feeding is executed by using another driving curve in step S6, that is, in the embodiment, by the constant driving in a manner similar to the case of the graphics printing.

Figure 5:
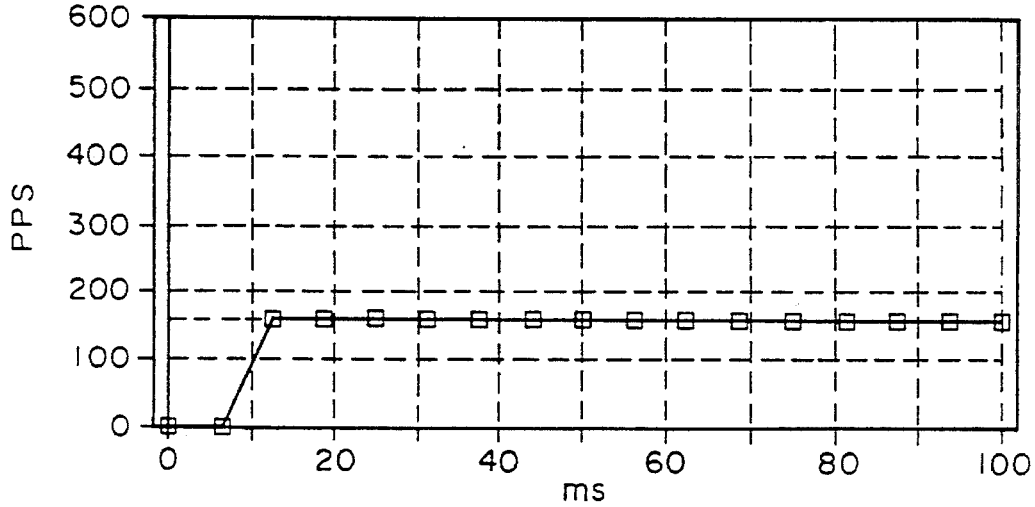

The constant driving is executed by switching the phases by a curve shown in FIG. 5. In this case, the carrier motor is driven at a constant speed of 160 PPS.

As shown in FIGS. 4 and 5, a time which is required to feed the sheet of the same amount, for instance, by 1/6 inch is equal to 60 msec or less in the through up/down mode and is equal to 100 ms in the constant mode. Thus, the time in the constant mode is fairly longer than that in the through up/down mode.

The value of 160 PPS has been set on the basis of the results of the measurements of sheet feeding precisions at respective speeds.

When comparing the above two kinds of modes, since a consideration is made in the through up/down mode with respect to the sound, the noise is quieter than the case in the constant mode. With regard to the time which is required to feed the sheet, the time in the through up/down mode is shorter than that in the constant mode as mentioned above. The sheet feeding precision in the constant mode is higher than that in the through up/down mode.

By executing the control as mentioned above, although the sheet feeding time is long and the noise is generated in the case of printing graphics or BGC, the sheet is fed at a high precision. In the case of the ordinary character printing, the sheet can be fed in a short time and with low noise.

Figure 6:
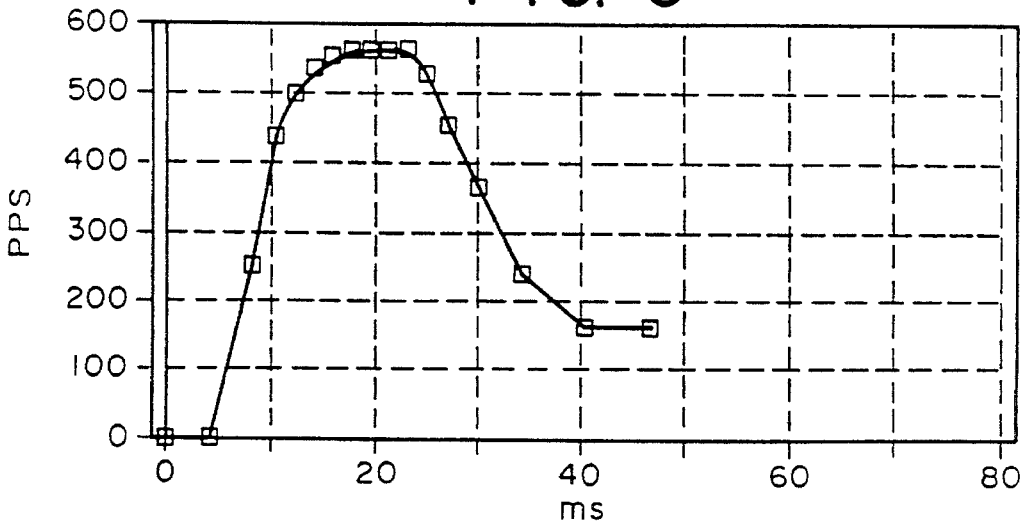

If a curve shown in FIG. 6 is used as another embodiment in place of the curve shown in FIG. 4, the sheet can be fed at a higher precision without largely changing the sheet feeding time and the sound generation.

According to the curve of FIG. 6, the phase switching time of the last two steps is equalized to the phase switching time in the constant mode shown in FIG. 5.

The sheet feeding precision depends on a stationary state of the motor. In the example of FIG. 6, attention is paid to such a point and there is used a phenomenon such that the sheet feeding precision is largely influenced in the latter half portion of the sheet feeding operation.

Figure 7:
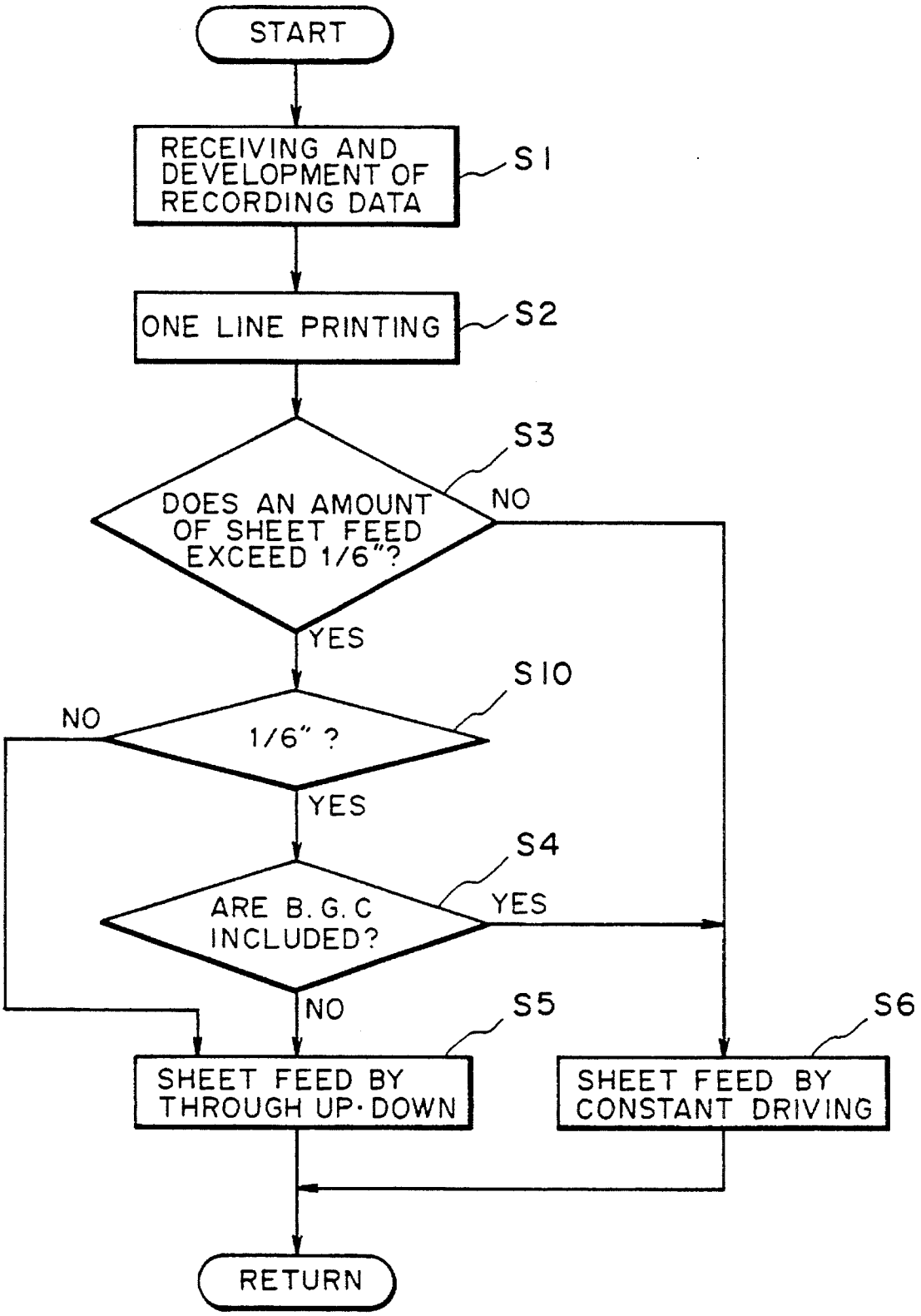
FIG. 7 is a flowchart showing a flow of a sheet feeding control of another embodiment of the invention.

As shown in FIG. 7, a discriminating step S10 can be also inserted between steps S3 and S4 in FIG. 6, thereby discriminating whether the sheet feed amount is just equal to ⅙ inch or not. The BGC is a character such that ruled lines or the like when forming, e.g., a table can be formed by a method similar to that of a character. A height of BGC is set to ⅙ inch. Therefore, by feeding the sheet on a ⅙ inch unit basis, the BGC of the upper line and the BGC of the lower line are vertically connected, so that a vertical ruled line or the like can be formed. Accordingly, even if a BGC exists on a certain line, for instance, the BGC is not vertically connected in the case of the sheet feeding operation in which the next sheet feed amount is larger than ⅙ inch. Thus, a high precision is unnecessary.

Therefore, the sheet feeding method in which an importance is paid to the precision is used only in the case where a BGC exists and the sheet feed amount is equal to ⅙ inch.

In the above description, the through up/down system has been used in the ordinary character printing mode and the constant system has been used in the BGC or graphics printing mode. However, even in the case of the BGC or graphics printing mode, the through up/down system is used when a high speed of a certain degree is necessary or the like and a system different from that in the ordinary character printing mode may be used.

As described above, the driving speed of the driving means for driving the relative moving means for relatively moving the recording means and the sheet is controlled by different modes in accordance with the kind of recording data, so that the recording means and the sheet can be relatively moved by paying an importance to the elements which are needed in each recording data printing mode. For instance, in the ordinary character printing mode, the relative movement in which a precision is set to a relatively low value and an importance is paid to both of the speed and the sound is executed. In the graphics printing mode, a relative movement in which more importance is paid to precision than the speed and noise can be performed. In the ordinary character printing mode, silent printing can be realized without deteriorating a throughput. In the graphics or BGC printing mode, a printing can be performed without an undesired white line, black line, or the like.

The invention provides an excellent effect in a recording apparatus of the ink jet system for recording by forming flying liquid droplets by using a thermal energy, particularly, among the ink jet recording systems.

As for the typical construction and principle, it is preferable to embody the invention by using the fundamental principles disclosed in, for instance, the specifications of U.S. Pat. Nos. 4,723,129 and 4,740,796. The above system can be applied to any one of what are called on-demand type and continuous type systems. Particularly, in the case of the on-demand type, at least one driving signal which corresponds to recording information and causes a sudden temperature increase exceeding nucleate boiling is applied to an electrothermal transducing element arranged in correspondence to a sheet or a liquid channel in which a liquid (ink) is held, thereby causing thermal energy to be generated in the electrothermal transducing element. A film boiling is caused on a heat acting surface of the recording head. As a result, an air bubble in the liquid (ink) corresponding to the driving signal in a one-to-one corresponding relation can be formed. Therefore, the above system is effective. The liquid (ink) is emitted through an emitting port by the growth and contraction of the air bubble, thereby forming at least one liquid droplet. By applying a pulse-shaped signal as a driving signal, the growth and contraction of the air bubble are quickly properly executed, so that the emission of the liquid (ink) having, particularly, an excellent response speed can be accomplished. Therefore, the use of such a pulse signal is more preferable.

As a pulse-shaped driving signal, it is suitable to use a signal disclosed in the specifications of U.S. Pat. Nos. 4,463,359 and 4,345,262. A further excellent recording can be performed by using the conditions disclosed in the specification of U.S. Pat. Ser. No. 4,313,124 of the invention regarding the temperature rising rate on the heat acting surface.

As a structure of the recording head, in addition to the combination structure (linear liquid channel or right-angled liquid channel) of the emitting port, liquid channel, and electrothermal transducing element as disclosed in each of the above specifications, it is also possible to use a structure in which the heat acting portion is arranged in a bent region as disclosed in the specifications of U.S. Pat. Nos. 4,558,333 and 4,459,600.

Further, it is also possible to use a structure in which a slit common to a plurality of electrothermal transducing elements is used as an emitting port of the electrothermal transducing elements as disclosed in Japanese Laid-Open Patent Application No. 59-123670 or a structure in which an opening which absorbs a pressure wave of a thermal energy is made correspond to the emitting port as disclosed in Japanese Laid-Open Patent Application No. 59-138461.

Further, it is also possible to use a recording head of the full-line type having a length corresponding to a width of the maximum recording medium which can be recorded by the recording apparatus. As such a recording head, it is possible to use a recording head having either a structure in which such a long length is satisfied by a combination of a plurality of recording heads as disclosed in the above specifications or a structure as a single recording head which is integrally formed.

In addition, the invention is also effective in the case of using a recording head of an exchangeable chip type which can be electrically connected to the apparatus main body or to which the ink can be supplied from the apparatus main body by being attached to the apparatus main body or the case of using a recording head of the cartridge type in which an ink tank is provided integrally in the recording head itself.

The addition of recovering means, spare auxiliary means, and the like to the recording head is preferable since the recording operation can be further stabilized. Practically speaking, it is possible to add capping means for the recording head, cleaning means, pressurizing or suction means, and preheating means by an electrothermal transducing element or another heating element different therefrom or a combination thereof. It is also possible to execute a preemitting mode for performing another emission different from the recording. The above means and method are also effective to execute the stable recording.

Further, the recording mode of the recording apparatus is not limited to the recording mode of only a main color such as black or the like but the recording head can be integrally constructed or can be also realized by a combination of a plurality of recording heads. It is also possible to use an apparatus having a plurality of different colors or at least one of mixed full colors.

According to the embodiment of the invention described above, the explanation has been made with respect to the case of the liquid ink. However, it is possible to use an ink which is solidified at a room temperature or less, an ink which is softened at a room temperature, or an ink which is a liquid at a room temperature. Generally the above ink jet system, the ink is adjusted within a temperature range from 30° C. to 70° C. and a temperature control is executed so that a viscosity of the ink lies within a stable emitting range. Therefore, it is sufficient that the ink is in a liquid state when a using recording signal is applied.

In addition, a temperature elevation due to a thermal energy is positively used as an energy of a state change from a solid state of the ink to a liquid state, thereby preventing solidification of the ink. Or, the ink which is solidified in a leaving state is used to prevent the evaporation of the ink. It is also possible to use an ink having a characteristic such that it is liquefied by a thermal energy for the first time, such as ink which is liquefied by applying thermal energy in accordance with the recording signal and is emitted as a liquid ink, ink such that the solidification has already been started at a time point when it reaches the recording medium, or the like. In such a case, the ink is held as a liquid or solid matter in concave portions or through holes of a porous sheet and in such a state, the ink faces the electrothermal transducing element as disclosed in Japanese Laid-Open Patent Application Nos. 54-56847 or 60-71260. In the invention, the foregoing film boiling system is the most effective method for each of the above inks.

Further, a style of the recording apparatus of the invention is not limited to a style in which the recording apparatus is integratedly or separately installed as an image output terminal of an information processing apparatus such as word processor, computer, or the like as mentioned above. Or, the invention can be also applied to a copying apparatus in combination with a reader or the like or a facsimile apparatus having transmitting and receiving functions.

What is claimed is:

1. A recording apparatus for recording various types of recording data on a recording sheet, said apparatus comprising:

recording means for recording an image having a predetermined width onto the recording sheet in accordance with a predetermined amount of recording data such that a main scan is effected in a first direction, the recording data being one of at least two types;

relative moving means operable in more than one operation mode for relatively moving the recording means and the recording sheet in a second direction different from the first direction by a distance corresponding to the predetermined width upon every completion of the main scan by the recording means, wherein a recording operation for a single recording sheet is completed by means of alternately repeating the main scan by the recording means and relative movement by the relative moving means; and control means for selecting the operation mode of the relative moving means regarding the relative movement of the distance corresponding to the predetermined width, upon every completion of the main scan in accordance with the type of the recording data recorded in the main scan, and activating said relative moving means in the selected operation mode.

2. An apparatus according to claim 1, wherein in the case where the recording data is graphics data or in the case where a block graphic character is included in the recording data, said control means controls the relative moving means in a mode in which a driving speed is set to a constant speed.

3. An apparatus according to claim 1, wherein in the case where the recording data is character data, said control means controls the relative moving means in a mode in which a driving speed is increased for a pre-determined time and, thereafter, the driving speed is decreased for a predetermined time.

4. An apparatus according to claim 2, wherein said control means controls the relative moving means in a mode in which the driving speed is set to a constant speed for a predetermined time after the driving speed has been decreased.

5. An apparatus according to any one of claims 1 to 4, wherein said recording means includes:

emitting ports each for emitting an ink;

ink channels communicated with the emitting ports; and energy generating means which are provided in a part of each ink channel and generate an emitting energy to form flying liquid droplets, and wherein by driving the energy generating means in accordance with the recording data, the ink is emitted from the emitting ports thereby recording an image.

6. An apparatus according to claim 5, wherein the energy generating means generates a thermal energy.

7. A recording apparatus for recording on a recording sheet, said apparatus comprising:

recording means for recording an image with a predetermined width onto the recording sheet in accordance with a predetermined amount of recording data such that a main scan is effected in a first direction;

relative moving means operable in more than one operation mode for relatively moving the recording means and the recording sheet in a second direction different from the first direction by a distance corresponding to the predetermined width upon every completion of the main scan by said recording means, wherein a recording operation for a single recording sheet is completed by means of alternately repeating the main scan by the recording means and relative movement by the relative moving means;

selection means for selecting the operation mode of the relative moving means regarding relative movement of the distance corresponding to the predetermined width, upon every completion of the main scan; and control means for activating the relative moving means in the operation mode selected by the selection means, wherein said selection means selects a first mode or a second mode in which accuracy in the relative movement is made much greater than that in the first mode.

8. An apparatus according to claim 7, wherein said selection means selects the first mode or the second mode in accordance with a type of the recording data.

9. An apparatus according to claim 8, wherein the first mode is a mode to execute the operation control in which more importance is paid to a speed than that in the second mode.

10. An apparatus according to claim 8, wherein said selection means selects the first mode when the recording data is character data.

11. An apparatus according to claim 8, wherein said selection means selects the second mode when the recording data is graphics data or data including block graphic data.

12. An apparatus according to any one of claims 7 to 9, 10 and 11, wherein the recording means includes:

emitting ports each for emitting an ink;

ink channels communicated with the emitting ports; and energy generating means which are provided in a part of each ink channel and generate an emitting energy to form flying liquid droplets, and wherein by driving the energy generating means in accordance with the recording data, the ink is emitted from the emitting ports, thereby forming an image.

13. An apparatus according to claim 12, wherein the energy generating means generates a thermal energy.

* * * * *

UNITED STATES PATENT AND TRADEMARK OFFICE

CERTIFICATE OF CORRECTION

PATENT NO. : 5,469,197 Page 1 of 3

DATED : November 21, 1995

INVENTOR(S) : Soichi HIRAMATSU

It is certified that error appears in the above-indentified patent and that said Letters Patent is hereby corrected as shown below:

COLUMN 2:

Line 52, "belt 10*c*" should read --belt 10*c*,--.

COLUMN 3:

Line 19, "are" should be deleted;
Line 40, "U-shaped" should read --U-shaped path--;
Line 43, "locating" should read --located--.

COLUMN 4:

Line 14, "rollers 2," should read --rollers 2*a*,--;
Line 27, "doesn't" should read --does not--;
Line 67, "a" (first occurrence) should read --an--.

COLUMN 6:

Line 9, "printed to be" should read --to be printed--;
Line 17, "Second)" should read --Second))--;
Line 36, "bland," should read --hand,--.

UNITED STATES PATENT AND TRADEMARK OFFICE

CERTIFICATE OF CORRECTION

PATENT NO. : 5,469,197 Page 2 of 3

DATED : November 21, 1995

INVENTOR(S) : Soichi HIRAMATSU

It is certified that error appears in the above-indentified patent and that said Letters Patent is hereby corrected as shown below:

COLUMN 7:

Line 5, "the noise" should read --noise--;
Line 24, "table" should read --table,--.

COLUMN 8:

Line 45, "correspond" should read --to correspond--.

COLUMN 9:

Line 19, "Generally" should read --Generally, in--;
Line 45, "integratedly" should read --integrally--.

COLUMN 10:

Line 18, "pre-determined" should read --predetermined--.

UNITED STATES PATENT AND TRADEMARK OFFICE

CERTIFICATE OF CORRECTION

PATENT NO. : 5,469,197 Page 3 of 3

DATED : November 21, 1995

INVENTOR(S) : Soichi HIRAMATSU

It is certified that error appears in the above-indentified patent and that said Letters Patent is hereby corrected as shown below:

COLUMN 11:

Line 10, "claims 7 to 9, 10" should read --claims 7 to 11,--;
Line 11, "and 11," should be deleted.

Signed and Sealed this

Sixth Day of August, 1996

*Attest:*

*Attesting Officer*

BRUCE LEHMAN

*Commissioner of Patents and Trademarks*